US009578912B2

(12) United States Patent
Cho

(10) Patent No.: US 9,578,912 B2
(45) Date of Patent: Feb. 28, 2017

(54) MULTI-FUNCTIONAL SWEATBAND

(71) Applicant: YUPOONG, INC., Seoul (KR)

(72) Inventor: Byoung-Woo Cho, Seoul (KR)

(73) Assignee: Yupoong, Inc. (KR)

( * ) Notice: Subject to any disclaimer, the term of this patent is extended or adjusted under 35 U.S.C. 154(b) by 11 days.

(21) Appl. No.: 13/971,265

(22) Filed: Aug. 20, 2013

(65) Prior Publication Data

US 2014/0059740 A1 Mar. 6, 2014

(30) Foreign Application Priority Data

Aug. 28, 2012 (KR) ..... 10-2012-0094401

(51) Int. Cl.

| | |
|---|---|
| ***A42C 5/00*** | (2006.01) |
| ***A42C 5/02*** | (2006.01) |
| ***A42B 1/00*** | (2006.01) |
| ***A42B 1/22*** | (2006.01) |

(52) U.S. Cl.

CPC ..... *A42B 1/00* (2013.01); *A42B 1/22* (2013.01); *A42C 5/02* (2013.01)

(58) Field of Classification Search

CPC ..... A41D 20/00; A41D 20/005; A41F 9/02; A42C 5/00; A42C 5/02; A42B 1/22; A42B 1/00

USPC ..... 139/422, 384 R; 2/181, 195.3

See application file for complete search history.

(56) References Cited

U.S. PATENT DOCUMENTS

| | | | | |
|---|---|---|---|---|
| 1,957,356 | A | 5/1934 | Rosen | |
| 3,280,406 | A | 10/1966 | Immel | |
| 3,597,300 | A * | 8/1971 | Miller | 428/193 |
| 3,860,046 | A * | 1/1975 | Goff et al. | 139/421 |
| 3,868,729 | A * | 3/1975 | Lynam | 2/237 |
| 4,856,116 | A * | 8/1989 | Sullivan | 2/181 |
| 5,146,630 | A * | 9/1992 | Richard | 2/181 |
| 5,566,395 | A | 10/1996 | Nebeker | |
| 5,715,540 | A | 2/1998 | Cho | |
| 5,887,284 | A | 3/1999 | Simmons | |
| 5,963,988 | A * | 10/1999 | Jackson, Jr. | 2/243.1 |
| 6,067,658 | A | 5/2000 | Cho | |
| 6,115,844 | A | 9/2000 | Cho | |
| 6,119,273 | A | 9/2000 | Cho | |
| 6,199,213 | B1 | 3/2001 | Whang | |
| 6,499,144 | B1 | 12/2002 | Yan | |
| 6,546,563 | B2 * | 4/2003 | Young | 2/181 |

(Continued)

FOREIGN PATENT DOCUMENTS

| | | | |
|---|---|---|---|
| GB | 987725 | A * | 3/1965 |
| KR | 20-0175917 | Y1 | 3/2000 |

(Continued)

*Primary Examiner* — Jameson Collier

(74) *Attorney, Agent, or Firm* — Fellers, Snider, Blankenship, Bailey & Tippens, P.C.

(57) ABSTRACT

A sweat absorber according to an exemplary embodiment of the present invention includes a first sweat absorber extended in a head circumferential direction and a second sweat absorber partially surrounding the first sweat absorber and formed of a different material having a different strechability, and the sweat absorber is highly stretchable, provides wearing comfort, improves sweat absorbing capability, is quick drying, and has antibacterial and deodorization functions, and provides a temperature control function to maintain a constant temperature.

11 Claims, 5 Drawing Sheets

(56) References Cited

U.S. PATENT DOCUMENTS

| | | | | |
|---|---|---|---|---|
| 6,625,818 | B2 | 9/2003 | Putnam | |
| 6,817,035 | B2 | 11/2004 | Park | |
| 6,928,660 | B2 | 8/2005 | Park | |
| 7,020,900 | B2 | 4/2006 | Ngan | |
| 7,039,957 | B2 | 5/2006 | Park | |
| 7,048,013 | B2 * | 5/2006 | Shannon | 139/422 |
| 7,117,542 | B2 | 10/2006 | Lee | |
| 7,159,247 | B2 | 1/2007 | Kim | |
| 7,174,572 | B1 * | 2/2007 | Diamond et al. | 2/181 |
| 7,213,270 | B2 | 5/2007 | Lee | |
| 7,278,172 | B2 | 10/2007 | Shin | |
| 7,337,810 | B2 * | 3/2008 | Orr et al. | 139/421 |
| D578,742 | S | 10/2008 | Cho | |
| 7,497,097 | B2 | 3/2009 | Herr | |
| D592,836 | S | 5/2009 | Cho | |
| D598,640 | S | 8/2009 | Cho | |
| D598,641 | S | 8/2009 | Cho | |
| D599,980 | S | 9/2009 | Cho | |
| 7,966,671 | B2 | 6/2011 | Cho | |
| 8,166,772 | B2 | 5/2012 | Cho | |
| 8,661,567 | B1 * | 3/2014 | Hoover et al. | 2/170 |
| 2003/0097705 | A1 * | 5/2003 | Han | 2/171 |
| 2004/0019954 | A1 | 2/2004 | Park | |
| 2004/0250336 | A1 | 12/2004 | Cho | |
| 2005/0028247 | A1 | 2/2005 | Kim | |
| 2005/0066420 | A1 | 3/2005 | Kim | |
| 2005/0081279 | A1 | 4/2005 | Cho | |
| 2005/0132469 | A1 | 6/2005 | Kim | |
| 2005/0155135 | A1 | 7/2005 | Cho | |
| 2005/0160518 | A1 | 7/2005 | Cho | |
| 2005/0160519 | A1 | 7/2005 | Cho | |
| 2005/0223472 | A1 | 10/2005 | Shin | |
| 2005/0223473 | A1 | 10/2005 | Cho | |
| 2005/0223474 | A1 | 10/2005 | Cho | |
| 2005/0235396 | A1 | 10/2005 | Lee | |
| 2006/0048274 | A1 | 3/2006 | Lee | |
| 2007/0079424 | A1 | 4/2007 | Cho | |
| 2007/0157366 | A1 | 7/2007 | Cho | |
| 2007/0245456 | A1 | 10/2007 | Cho | |
| 2009/0183300 | A1 | 7/2009 | Cho | |
| 2009/0260130 | A1 * | 10/2009 | Wang | 2/182.8 |

FOREIGN PATENT DOCUMENTS

| | | | |
|---|---|---|---|
| KR | 1020040104023 | A | 12/2004 |
| KR | 10-2006-0068783 | | 6/2006 |
| KR | 10-0669440 | | 1/2007 |

* cited by examiner

| Elastic stretchablility(%) | 0 | 2.5 | 5 | 7.5 | 10 | 12.5 | 15 | 17.5 | 20 | 22.5 | 25 |
|---|---|---|---|---|---|---|---|---|---|---|---|
| ----- Sweat absorber 1 | 374 | 604 | 800 | 961 | 1102 | 1222 | 1318 | 1403 | 1491 | 1589 | 1692 |
| ——— Sweat absorber 2 | 0 | 7 | 69 | 147 | 234 | 333 | 438 | 550 | 672 | 801 | 941 |

MULTI-FUNCTIONAL SWEATBAND

CROSS REFERENCE TO RELATED APPLICATIONS

This application claims priority to and the benefit of Korean Patent Application No. 10-2012-0094401 filed in the Korean Intellectual Property Office on Aug. 28, 2012, the entire contents of which are incorporated herein by reference.

FIELD OF THE INVENTION

The present invention relates to an elastic multi-functional sweat absorber having improved wearing comfort. More particularly, the present invention relates to a multi-functional sweat absorber that is highly stretchable and provides wearing comfort, improves sweat absorbing capability, is quick drying, and has antibacterial and deodorization functions, and provides a temperature control function to maintain a constant temperature.

BACKGROUND OF THE INVENTION

In general, headwear includes a crown portion worn on a head of a wearer, a visor portion coupled to the crown portion and functioning as a visor, and a sweat absorber disposed at an interior circumference of the crown portion so as to prevent sweat produced from the head or forehead from flowing to the eyes or face of the wearer.

The sweat absorber directly contacts the skin and thus is closely related to sensitivity of the wearer. In particular, when the headwear is free-sized and thus both of the crown portion and the sweat absorber have elasticity, the sweat absorber is closely attached to the head, and accordingly, the function and importance of the sweat absorber are higher than with other styles of headwear.

The sweat absorber prevents sweat produced from the head or forehead during exercise from flowing to the face or eyes.

In addition, the sweat absorber reduces pressure applied to the head or forehead due to the hard sewing portion of the visor portion or the crown portion.

Although it is limited to a free-sized product, the sweat absorber may be elastically stretchable to make the elastic crown portion fit the head size of the wearer.

Thus, the sweat absorber of the free-sized headwear may not be able to fully satisfy the above-stated functions.

When the sweat absorber is formed of an only elastic band, elasticity may be improved and various expressions such as a logo or characters can be woven in the outer surface thereof, but impressions may be remained on the forehead of the wearer along the edge of the sweat absorber or the wearer may have uncomfortable feelings and sensations of compression on the forehead. Further, if the wearer wears on the hat for a long time, sweat may flow to the face or eyes of the wearer because the elastic band is formed of a single sheet.

When the sweat absorber is formed of an elastic band and a cover portion that surrounds the elastic band, impression and compression problems can be reduced such that the wearing comfort may be improved, but the headwear may not be applied to various-sized heads because elasticity is weakened.

In addition, characters or logos may be woven on the cover portion of the sweat absorber, but workability may be deteriorated and a loss may occur due to cutting.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an elastically stretchable multi-functional sweat absorber that is highly stretchable and provides wearing comfort, improves sweat absorbing capability, is quick drying, and has antibacterial and deodorization functions, as well as providing a temperature control function to maintain a constant temperature.

A sweat absorber according to an exemplary embodiment of the present invention includes a first sweat absorber extended in a head circumferential direction or circular or oval direction and a second sweat absorber partially surrounding the first sweat absorber wherein the first sweat absorber and the second sweat absorber are formed of a different material having an elasticity difference.

The sweat absorber according to the exemplary embodiment of the present invention uses polypropylene as at least one of a warp yarn and a weft yarn.

The sweat absorber according to the exemplary embodiment of the present invention is highly stretchable, provides wearing comfort, improves sweat absorbing capability, is quick drying, and has antibacterial and deodorization functions, and provides a temperature control function to maintain a constant temperature.

In addition, the first sweat absorber and the second sweat absorber may have the same color, but they may have different colors such that the headwear may provide an aesthetic effect, and functionality of the headwear can be further visually emphasized.

Further, the second sweat absorber can be detachably formed using a female or male fastening portion formed of Velcro and the like rather than being integrally formed with the first sweat absorber such that replacement can be easily performed.

DETAILED DESCRIPTION OF THE PREFERRED EMBODIMENTS

Hereinafter, an exemplary embodiment of the present invention will be described with reference to the accompanying drawings.

Figure 1:
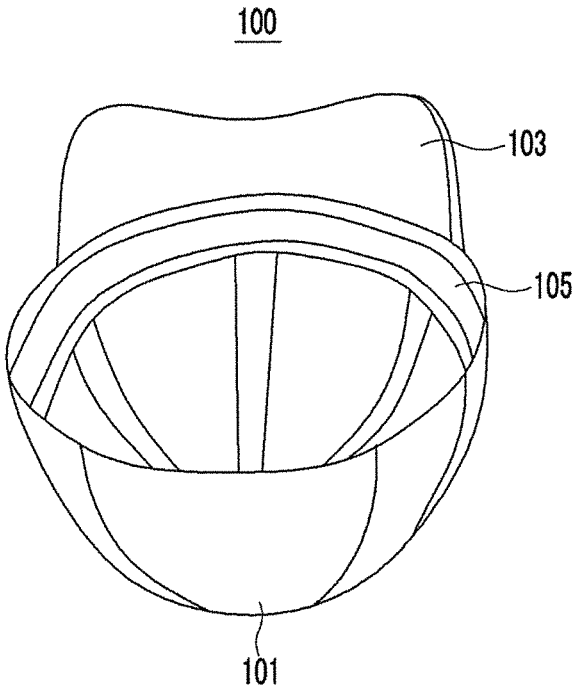
FIG. 1 is a bottom perspective view of headwear having a sweat absorber according to an exemplary embodiment of the present invention.
Figure 2:
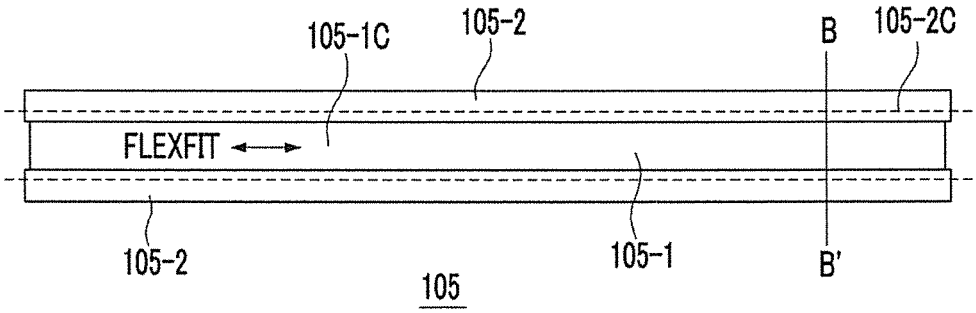
FIG. 2 is a top plan view of a sweat absorber according to the exemplary embodiment of the present invention.

FIG. 1 is a bottom perspective view of headwear having a sweat absorber according to an exemplary embodiment of the present invention, and FIG. 2 is a top plan view of the sweat absorber according to the exemplary embodiment of the present invention.

Referring to FIG. 1, headwear 100 having the sweat absorber according to the exemplary embodiment of the present invention includes a crown portion 101 worn on the head of a wearer, a visor portion 103 coupled to the crown portion 101 to function as a visor, and a sweat absorber 105 coupled to an inner circumferential portion of the crown portion 101.

The present invention is not limited to the cap-type headwear having the crown portion 101 of FIG. 1, but FIG. 1 exemplarily illustrates one example of the present invention. The present invention may be applied to various types of headwear such as a visor used for blocking sunlight in summer or formal headwear.

As shown in FIG. 2, the sweat absorber 105 according to the exemplary embodiment of the present invention is elastically stretchable in a longitudinal direction (i.e., the arrow direction), and includes a first sweat absorber 105-1 and a second sweat absorber 105-2 partially surrounding a front of the first sweat absorber 105-1 and sewn by a sewing yarn 105-2C.

The first sweat absorber 105-1 and the second sweat absorber 105-2 may be respectively formed of different materials, each having different stretchability, and this will be described later.

In the sweat absorber 105 according to the exemplary embodiment of the present invention, a pattern portion 105-1C such as characters or logos is woven together when the first sweat absorber 105-1 is woven using a warp yarn (head circumferential direction, length direction, or arrow direction; (105-1*aa* of FIG. 3B) and a weft yarn (105-1*ab* of FIG. 3B), and thus a loss can be reduced compared to a case of printing using a cover, and the pattern portion 105-1C can be located in a desired correct location thereby providing aesthetic appreciation.

The first sweat absorber 105-1 and the second sweat absorber 105-2 may have the same color, or they may have different colors such that the headwear may provide an aesthetic effect, and functionality of the headwear can be further visually emphasized.

Figure 3A:
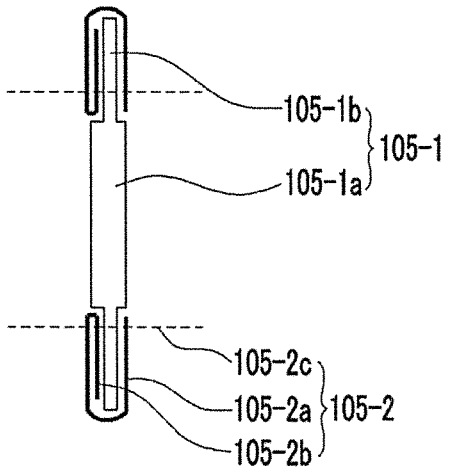
FIG. 3A is a cross-sectional view of FIG. 2, taken along the line B-B.
Figure 3B:
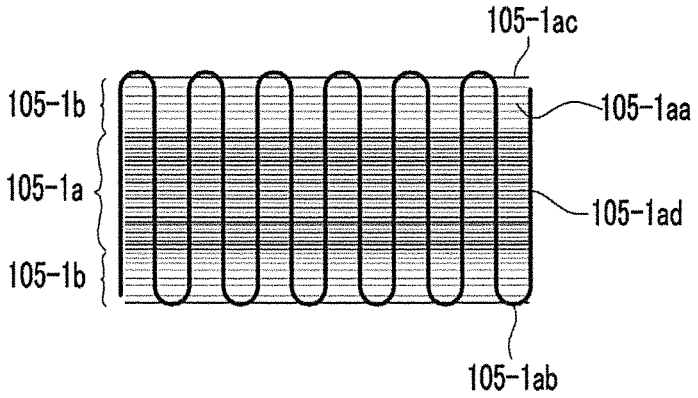
FIG. 3B is an enlarged top plan view for description of a method for manufacturing a first sweat absorber of the sweat absorber according to the exemplary embodiment of the present invention.

Referring to FIG. 3A and FIG. 3B, a configuration of the sweat absorber according to the exemplary embodiment of the present invention will be described in further detail.

FIG. 3A is a cross-sectional view of FIG. 2, taken along the line B-B, and FIG. 3B is an enlarged top plan view provided for description of a manufacturing method of the first sweat absorber of the sweat absorber according to the exemplary embodiment of the present invention.

As shown in FIG. 3A, the functional sweat absorber 105 according to the exemplary embodiment of the present invention has a structure in which the first sweat absorber 105-1 is formed of a main body portion 105-1*a* and a wing portion 105-1*b* that is integrally formed at both ends from the main body portion 105-1*a* in a direction of the weft yarn and is partially surrounded by the second sweat absorber 105-2 that is formed of two sheets of separation-type piece panels. Each of the front and rear sides of the first sweat absorber 105-1 have an exposed portion due to the partial surrounding by the second sweat absorber 105-2.

In the first sweat absorber 105-1, at least one of the warp yarn 105-1*aa* and the weft yarn 105-1*ab* is woven from polypropylene, and particularly, an elastically stretchable yarn 105-1*ac* is partially used as the warp yarn for elastic stretchability in a direction of the weft yarn (i.e., the head circumferential direction marked by the arrow in FIG. 2).

The second sweat absorber 105-2 is formed of two sheets of piece panels formed by sewing a cover portion 105-2*a* surrounding the wing portion 105-1*b* of the first sweat absorber 105-1 from a rear side and a sewing portion 105-2*b* bent inward at a front end of the cover portion 105-2*a* and thus disposed in a front of the wing portion 105-1*b* with a sewing yarn 105-2*c*, and the second sweat absorber 105-2 improves tactility of a portion that imprints impressions on the forehead of the wearer or applies compression to the forehead by contacting the forehead.

Since the sewing portion 105-2*b* is disposed in the front of the wing portion 105-1*b*, the design of the headwear can be aesthetically improved by matching different textures or colors.

The cover portion 105-2*a* and the sewing portion 105-2*b* of the second sweat absorber 105-2 may be formed of a fabric or knit that is integrally woven or knitted and thus is stretchable in the head circumferential direction.

Referring to FIG. 3B, the first sweat absorber 105-1 of the functional sweat absorber according to the exemplary embodiment of the present invention will be described in further detail.

The first sweat absorber 105-1 functions to determine a size range of a free-sized headwear, and as shown in Table 1, the main body portion 105-1*a* is formed further thicker by increasing the density of the warp yarn with a pattern yarn 105-1*ad* to form characters and both wing portions 105-1*b*, which may be referred to as first wing portion and second wing portion, are formed thinner by decreasing the density of a bottom yarn 105-1*aa*, which is the warp yarn.

The density of the warp yarn of the first sweat absorber 105-1 is 147 strands/inch, which is less than 220 strands/inch of a comparative example, and a first density of the warp yarn 105-1*aa* in the main body portion 105-1*a* formed of the pattern yarn 105-1*ad* such as a logo or a pattern is higher than a second density of in the wing portions 105-1*b*. For example, 104 strands among about 147 strands are concentrated in the main body portion 105-1*a*, and the density of strands in the wing portions 105-1*b* are significantly reduced to about 21 strands and 22 strands, respectively.

Since the second density of the wrap yarn of the wing portions 105-1*b* is lower than the first density of the warp yarn of the main body portion 105-1*a*, the wing portions 105-1*b* are thin and less pressed, but the wing portions 105-1*b* are covered by the second sweat absorber 105-2 so that wearing comfort can be improved when being close to the forehead of the wearer.

In addition, the density of the stretchable yarn 105-1*ac* of the first sweat absorber 105-1 according to the exemplary embodiment of the present invention is decreased to 9 strands compared to 20 to 30 strands of the comparative example with reference to the width of about 30 mm, so that feeling of pressure in wearing can be reduced.

The first sweat absorber 105-1 according to the exemplary embodiment of the present invention uses a reduced number of elastically stretchable yarns 105-1*ac* but uses a monofilament yarn having elasticity and strength as the weft yarn 105-1*ab* rather than using a multifilament yarn, unlike the comparative example, and therefore sufficient stretchability can be provided from the combination of the elastically stretchable yarns and the weft yarns 105-1*ab*.

As shown in Table 1, in case of the comparative example in which warp yarns and weft yarns have compact densities, 20 to 30 strands of elastically stretchable yarns are added to provide stretchability of more than 25% and thus compression also can be increased as the number of elastically stretchable yarns is increased.

The first sweat absorber 105-1 according to the exemplary embodiment of the present invention uses the reduced number of elastically stretchable yarns 105-1*ac* so that the compression of 35% is improved compared to that of the comparative example when being stretched 25%.

TABLE 1

| | | First sweat absorber 105-1 | Comparative Example FLEXFIT ® (sweat absorber of the applicant) |
|---|---|---|---|
| Warp yarn | Warp yarn density (pattern yarn, bottom yarn) | About 147 strands | About 220 strands |
| | Stretchable yarn density | About 9 strands | About 20 to 30 strands |
| Weft warn | | monofilament | Multifilament |
| Pressure (load, gf) from 25% of stretch | | Average 1692 (36% improved compared to comparative example) | Average 2650 |

According to the exemplary embodiment of the present invention, an elastic yarn formed of polyester-covered latex or a PU yarn may be used as the stretchable yarns 105-1*ac* respectively arranged with a constant gap along the width direction of the first sweat absorber 105-1.

The main body portion 105-1*a* of the first sweat absorber 105-1 is formed of the pattern yarn 105-1*ad* that forms a logo, a character, or a pattern, and may include about 104 strands with reference to the width of about 30 mm and is made of polyester or nylon for improving a sense of beauty and texture.

The wing portion 105-1*b* of the first sweat absorber 105-1 is formed of the bottom yarns 105*aa* made of polyester or nylon.

Thus, the main body portion 105-1*a* is thicker than the wing portion 105-1*b*.

As described above, the weft yarn 105-1*ab* is arranged along the width direction of the sweat absorber, and one strand of a monofilament yarn is zigzagged and thus weaved with the warp yarns 105-1*aa*. Since the weft yarn 105-1*ab* is formed of the monofilament yarn, the sweat absorber 105 can be closely attached to the crown portion 101 due to the elasticity and strength of the weft yarn even through the weft yarn has lower density than the warp yarn 105-1*aa*, and the bottom of the crown portion 101 can be maintained in the round shape.

The weft yarn 105-1*ab* can support the round shape of the crown portion 101 after attaching the sweat absorber 105 to the crown portion 101, and the density is preferably about 90 to 110 strand/inch.

One of the weft yarn and the warp yarn used in the main body portion includes a polypropylene yarn for moisture permeability and quick drying, and therefore the sweat absorber 105 according to the exemplary embodiment of the present invention is lighter than that of the comparative example, and sweat can be sufficiently emitted and anti-bacterial and deodorization functions can be provided even through the thickness of the sweat absorber 105 is further decreased.

The polypropylene yarn has moisture absorptivity of 0.05%, which is close to zero, and thus it transports humidity to the outside, thereby providing the anti-bacterial and deodorization functions and the load of the polypropylene yarn is 0.92, the lightest among fibers, so that the sweat absorber can be light-weighted. Further, thermal conductivity of the polypropylene yarn is the lowest among fibers so that it can provide thermal insulation and cool insulation effects by blocking high temperature in summer and blocking emission of body temperature to the outside in winter.

In particular, the polypropylene yarn used in the exemplary embodiment of the present invention is spun by mixing an additional inorganic compound so that excellent anti-bacterial and deodorization functions and thermal insulation and cool insulation functions can be provided.

The second sweat absorber 105-2 supports extension of the first sweat absorber 105-1 in the head circumferential direction so that a knit is preferably used rather than using a stretchable yarn.

In the exemplary embodiment of the present invention, the knit can be extended and then restored not 100% but somewhat, and thus the second sweat absorber 105-2 can be extended as much as the first sweat absorber 105-1 and accordingly the headwear can be applicable to various sizes of heads. In this case, it is preferred to improve wearing comfort by using thinner and softer yarn and formation.

A sense of soft touch may be provided by using micro yarn of less than 1 denier, i.e., 75D/72F or 150D/144F, as the second sweat absorber 105-2.

In addition, a shaped yarn or sweat absorption and quick dry can be provided by post-processing an absorption softener. Even through polyurethane (PU) is not mixed, a warp knit or a weft knit using 100% polyester yarn is used for natural stretchability. Further, a single jersey is used to prevent impressions from remaining in the forehead of the wearer when the headwear is being worn by performing to be thin.

As described, since the shaped yarn or post-processed absorption softener is used as the second sweat absorber 105-2, moisture or sweat can be well absorbed and quickly dried so that sweat can be more quickly absorbed and more quickly dried by supporting the first sweat absorber 105-1.

Figure 4:
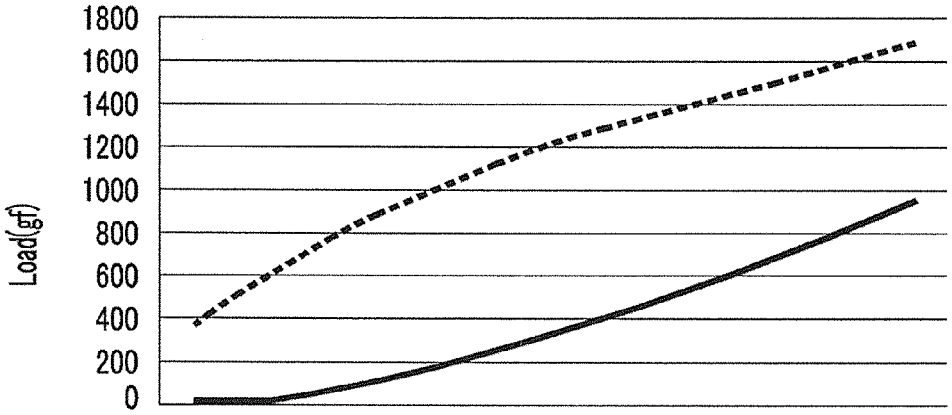
FIG. 4 is a graph showing an elasticity difference between a first sweat absorber and a second sweat absorber according to the exemplary embodiment of the present invention.

With reference to FIG. 4, it will be described in detail that the second sweat absorber 105-2 can be extended sufficiently in accordance with the extension of the first sweat absorber 105-1 in the sweat absorber 105 according to the exemplary embodiment of the present invention.

FIG. 4 is a graph illustrating a stretchability difference between the first sweat absorber and the second sweat absorber of the sweat absorber according to the exemplary embodiment of the present invention.

As shown in FIG. 4, a load of about 374 gf is applied when the first sweat absorber 105-1 is not stretched and a load of about 1692 gf is applied when being stretched to 25%, and a load of almost 0 gf is applied when the second sweat absorber 105-2 is not stretched and a load of about 941 gf is applied when being stretched to 25%. Therefore, it can be seen that the first sweat absorber and the second sweat absorber have different force requirements to produce an elongation amount.

Since almost zero load is applied to the second sweat absorber 105-2 when being stretched according to stretch of the first sweat absorber 105-1, the second sweat absorber 105-2 can support functionality and wearing comfort without interfering with the stretch of the first sweat absorber 105-1.

That is, when the sweat absorber 105 is formed of only the first sweat absorber 105-1, sweat may be permeated to the crown portion 101 due to the material of the first sweat absorber 105-1 and thus sweat may smear on the crown portion 101 or run down to the face or eyes of the wearer. However, when the sweat absorber 105 is formed of the first and second sweat absorbers 105-1 and 105-2, the second sweat absorber 105-2 can absorb the sweat and quickly dry, and deterioration of wearing comfort due to compression or impressions from the first sweat absorber 105-1 can be prevented.

A sweat absorber according to an exemplary variation will now be described with reference to FIG. 5A to FIG. 5C.

Figure 5A:
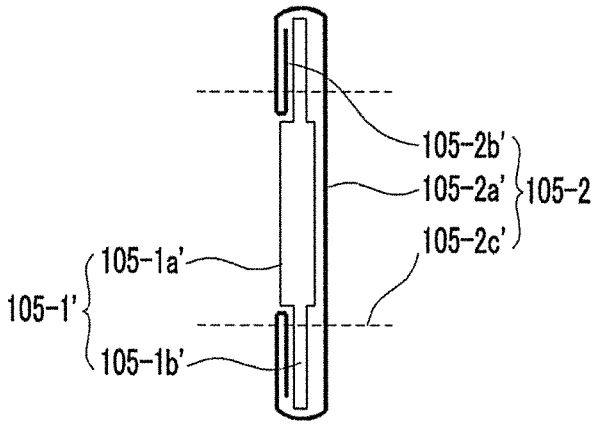
FIG. 5A is a cross-sectional view of an exemplary variation of the sweat absorber of FIG. 2 of the present invention, taken along the line B-B.
Figure 5B:
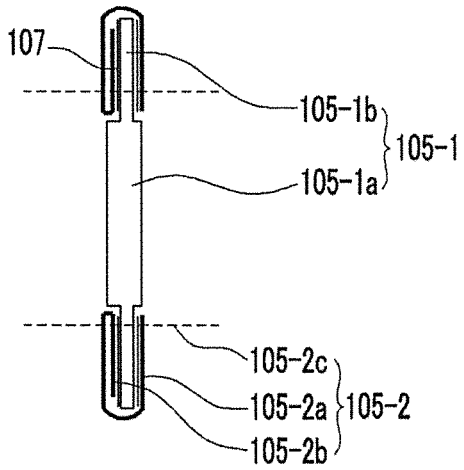
FIG. 5B shows an exemplary variation of FIG. 3A.
Figure 5C:
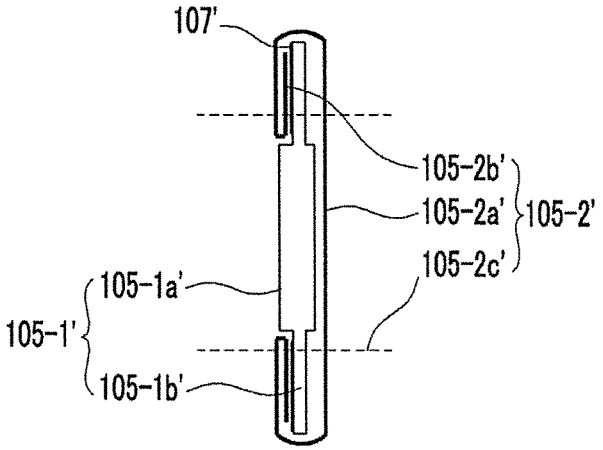
FIG. 5C shows an exemplary variation of FIG. 5A.

FIG. 5A is a cross-sectional view of a sweat absorber according to the exemplary variation of the present invention of FIG. 2, taken along the line B-B, FIG. 5B shows an exemplary variation of FIG. 3A, and FIG. 5C shows an exemplary variation of FIG. 5A.

According to an exemplary variation embodiment of the present invention, as shown in FIG. 5A, a second sweat absorber 105-2' is formed of one panel formed by connecting a cover portion 105-2*a*' and two sewing portions 105-2*b*', and the cover portion 105-2*a*' faces one side of a main body portion 105-1*a*' of a first sweat absorber 105-1'. The sewing portions 105-2*b*' formed by surrounding wing portions 105-1*b*' may be coupled using a sewing yarn 105-2*c*'.

Meanwhile, as shown in FIG. 5B, female or male fastening portions 107 formed as Velcro, a loop, or a hook are formed in the wing portions 105-1*b* provided in both ends of the main body portion 105-1*a* of the first sweat absorber 105-1 and in inner both ends of the second sweat absorber 105-2 so as to provide a fastening of the second sweat absorber 105-2 to the first sweat absorber 105-1.

Also, as shown in FIG. 5C, the second sweat absorber 105-2' may be formed of a single panel by connecting the cover portion 105-2*a*' and the sewing portion 105-2*b*', and the cover portion 105-2*a* may face one side of the main body portion 105-1*a* of the first sweat absorber 105-1'. Then, a female or male fastening portion 107' formed as Velcro, a loop, or a hook is formed in the sewing portion 105-2*b*' corresponding to the wing portion 105-1*b*' so as to provide a fastening of the second sweat absorber 105-2' to the first sweat absorber 105-1'.

With such a configuration, the sweat absorber can be maintained clean by changing only the second sweat absorbers 105-2 and 105-2' when the second sweat absorbers 105-2 and 105-2' are stained with sweat.

The second sweat absorbers 105-2 and 105-2' surround the upper and lower ends of the first sweat absorbers 105-1 and 105-1', that is, the wing portions 105-1*b* and 105-1*b*', so that an unpleasant feeling from the first sweat absorbers 105-1 and 105-1' can be reduced and impressions due to compression of the first sweat absorbers 105-1 and 105-1' can be prevented from being imprinted even though a monofilament yarn is used as the weft yarn at the portion of the headwear that contacts the sensitive forehead when being worn on the head.

In addition, the main body portions 105-1*a* and 105-1*a*' of the first sweat absorbers 105-1 and 105-1' may be thickened due to pattern portions 105-1*c* and 105-1*c*' where characters or logos are formed, but the wing portions 105-1*b* and 105-1*b*' of the upper and lower ends are surrounded so that the sweat absorber 105 can be entirely smoothened, thereby improving wearing comfort.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of Symbols> | |
|---|---|
| 101: crown portion | 103: visor portion |
| 105: sweat absorber | 105-1: first sweat absorber |
| 105-2: second sweat absorber | 105-1a: main body portion |
| 105-1b: wing portion | 105-1c: logo portion |
| 105-2a: cover portion | 105-2b: sewing portion |
| 107: female or male fastening portion | |

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. An elastically stretchable multi-function head band improved in wearing comfort, the head band comprising a first sweat absorber and a second sweat absorber, said first sweat absorber extended in a circular or oval direction for surrounding a head of a wearer, said head band having a front side and a rear side, said first sweat absorber having a front side having an exposed portion for contacting a forehead of a wearer, a rear side having an exposed portion, an upper end, and a lower end, and said second sweat absorber surrounding said upper end and said lower end and partially surrounding said front side of said head band, whereby said front side of said head band comprises a first portion of said second sweat absorber and a second portion of said second sweat absorber, said first portion and said second portion separated by said exposed portion of said first sweat absorber, the first sweat absorber formed of a different type of material than said second sweat absorber each, said first sweat absorber and said second sweat absorber having different force requirements than one another to produce a same elongation amount; and wherein said multi-function head band is affixed to a crown portion of a hat.

2. The head band of claim 1, wherein the first sweat absorber comprises a main body portion, a first wing portion and a second wing portion, wherein said first wing portion extends from an upper end of said main body portion and wherein said second wing portion extends from a lower end of the main body portion, and a thickness of the main body portion is greater than a thickness of the first wing portion and greater than a thickness of the second wing portion; wherein the second sweat absorber is further formed of a first sheet of a first piece panel including a first cover portion facing said rear side of said head band and a first sewing portion coupled with the first wing portion on a front side of said first wing portion; the second sweat absorber is further formed of a second sheet of a second piece panel including a second cover portion facing said rear side of said head band and a second sewing portion coupled with the second wing portion on a front side of said second wing portion; and wherein said front side of said head band is defined by said first sweat absorber and said second sweat absorber and said front side of said head band is smooth.

3. The head band of claim 2, wherein the second sweat absorber is one panel formed by connecting said first cover portion and said second cover portion facing one side of the main body portion and said second sweat absorber having said first sewing portion surrounding said first wing portion and said second sewing portion surrounding said second wing portion.

4. The head band of claim 3, wherein the first sewing portion is provided in the front side of the first wing portion of the first sweat absorber and the second sewing portion is provided in the front side of the second wing portion of the first sweat absorber.

5. The head band of claim 2, wherein the main body portion of the first sweat absorber has a first warp yarn density, and the first wing portion and the second wing portion each have a second warp yarn density; and wherein the first warp yarn density is greater than the second warp yarn density.

6. The head band of claim 2, wherein the first sewing portion is provided in a front of the first wing portion of the first sweat absorber and the second sewing portion is provided in a front of the second wing portion of the first sweat absorber.

7. The head band of claim 1, wherein:

said first sweat absorber has a warp yarn and a weft yarn wherein at least one of said warp yarn and said weft yarn is comprised of polypropylene having an absorption ratio of about 0.05% to be quickly dried;

wherein the weft yarn of said first sweat absorber is comprised of a monofilament yarn.

8. The head band of claim 1, wherein the second sweat absorber is formed of a knit.

9. The head band of claim 1, wherein the second sweat absorber is formed of a first sheet of a first piece panel including a first cover portion that surrounds a first wing portion and a first sewing portion coupled with the first wing portion; the second sweat absorber is further formed of a second sheet of a second piece panel including a second cover portion that surrounds a second wing portion and a second sewing portion coupled with the second wing portion and wherein the first sheet of the first piece panel is coupled with the first wing portion of the first sweat absorber by a sewing yarn and the second sheet of the second piece panel is coupled with the second wing portion of the first sweat absorber by a sewing yarn.

10. The head band of claim 1, wherein the second sweat absorber is female-and-male fastened to the first sweat absorber by female or male fastening portions in an inner lateral end of a first piece panel of the second sweat absorber with a first wing portion of the first sweat absorber and an inner lateral end of a second piece panel of the second sweat absorber with a second wing portion of the first sweat absorber.

11. An elastically stretchable multi-function head band improved in wearing comfort, the head band comprising a first sweat absorber extended in a circular or oval direction for surrounding a head of a wearer and a second sweat absorber surrounding the first sweat absorber and formed of a different type of material than said first sweat absorber, said first and second sweat absorbers having different force requirements than one another to produce a same elongation amount; and wherein said multi-function head band is affixed to a crown portion of a hat;

wherein the first sweat absorber comprises a main body portion, a first wing portion and a second wing portion, wherein said first wing portion extends from an upper end of said main body portion and wherein said second wing portion extends from a lower end of the main body portion, and a thickness of the main body portion is greater than a thickness of the first wing portion and greater than a thickness of the second wing portion; wherein the second sweat absorber is formed of a first sheet of a first piece panel including a first cover portion that surrounds the first wing portion and a first sewing portion coupled with the first wing portion; wherein said second sweat absorber further includes a second sheet of a second piece panel including a second cover portion that surrounds the second wing portion and a second sewing portion coupled with the second wing portion; and wherein a front surface defined by said first sweat absorber and said second sweat absorber is smooth; and wherein the main body portion of the first sweat absorber has a first warp yarn density, and the first wing portion and the second wing portion each have a second warp yarn density; and wherein the first warp yarn density is greater than the second warp yarn density.

* * * * *